United States Patent [19]

Burns

[11] Patent Number: 4,722,400

[45] Date of Patent: Feb. 2, 1988

[54] MECHANICALLY ACTUATED SUBSURFACE INJECTION TOOL

[75] Inventor: Robert E. Burns, Houston, Tex.

[73] Assignee: Baker Oil Tools, Inc., Orange, Calif.

[21] Appl. No.: 862,137

[22] Filed: May 12, 1986

[51] Int. Cl.[4] ..... E21B 34/12

[52] U.S. Cl. ..... 166/330; 166/324; 166/131

[58] Field of Search ..... 166/120, 127–129, 166/131, 142, 193, 194, 324, 330, 332, 386

[56] References Cited

U.S. PATENT DOCUMENTS

| | | | |
|---|---|---|---|
| Re. 25,639 | 8/1964 | Clark, Jr. et al. | 166/129 |
| Re. 26,085 | 9/1966 | Myers | 166/120 |
| 2,042,817 | 6/1936 | Wilcox | 166/127 |
| 2,227,539 | 1/1941 | Dorton | 166/193 X |
| 2,720,926 | 10/1955 | Brown | 166/330 |
| 2,733,769 | 2/1956 | Brown | 166/330 |
| 2,970,649 | 2/1961 | Brown | 166/330 X |
| 3,008,523 | 11/1961 | Clark, Jr. et al. | 166/120 X |
| 3,112,795 | 12/1963 | Keithahn | 166/120 |
| 3,398,796 | 8/1968 | Fisher, Jr. et al. | 166/120 |
| 3,412,799 | 11/1968 | Ellis | 166/131 X |
| 3,434,538 | 3/1969 | Kilgore et al. | 166/131 X |
| 3,497,009 | 2/1970 | Harrington | 166/330 |
| 3,517,743 | 6/1970 | Pumpelly et al. | 166/127 |
| 3,861,465 | 1/1975 | Mignotte | 166/127 X |
| 4,258,787 | 3/1981 | Amancharla | 166/120 |
| 4,567,944 | 2/1986 | Zunkel et al. | 166/120 |
| 4,605,062 | 8/1986 | Klumpyan et al. | 166/127 |

*Primary Examiner*—Stephen J. Novosad
*Assistant Examiner*—John F. Letchford
*Attorney, Agent, or Firm*—Norvell & Associates

[57] ABSTRACT

An injection tool for use in injecting fluids into perforations of a production formation of an oil or gas well is mechanically set in the bore of the casing traversing the production formation, and mechanically releasable therefrom so that chemical treatment fluid can be injected between upper and lower packing elements into a single or a selected vertical group of perforations. The injection tool is connected to the tubing string by a circulation valve operable by rotational movement of the tubing string. Injection of the chemical fluid treatment is accomplished with the circulation valve in the closed position, while the circulation valve is opened to equalize tubing and annulus pressure whenever required.

5 Claims, 19 Drawing Figures

MECHANICALLY ACTUATED SUBSURFACE INJECTION TOOL

RELATIONSHIP TO OTHER CO-PENDING APPLICATIONS

This application is related in subject matter to application Ser. No. 742,994, filed Jun. 10, 1985, and assigned to the Assignee of the instant application, now U.S. Pat. No. 4,605,062.

BACKGROUND OF THE INVENTION

1. Field of the Invention

This invention relates to a subsurface well tool for use in oil and gas wells for injecting fluids into perforations of a production formation traversed by the well casing; more specifically, to a well tool mechanically set by axial manipulation of the tubing string and providing for pressure equalization across packing elements on opposite sides of a selected group of perforations and additionally effecting pressure equalization between the well annulus and the bore of the tubing string carrying the tool by rotation of the tubing string to facilitate release of the well too from its set condition.

2. Description of the Prior Art

It is often necessary to inject fluids, such as water, acid or various types of chemicals, into an underground formation through perforations in the casing which provide for communication between perforations in the formation and the bore of the casing. Most conventional tools used to inject fluids into a selected vertical group of perforations contained within a specified interval of the well require the use of two tools, suspended in series by a tubing string, one above the interval and one below the interval, and connected together to permit fluid injection. Thus, an upper packer can be secured to a ported tubing section which is in turn secured to a lower packer, thus providing isolation for the intermediate interval.

These tools are suitable only for injecting fluids into intervals of six feet or greater height. Prior art tools are not suitable for injecting fluids into selected intervals as small as six inches in vertical height, which may be desirable if fluids must be selectively injected into a single or closely adjacent well perforations. The conventional multipacker device is unsuitable for use in injecting fluids into such small intervals because the mechanism necessary to set each packer renders it virtually impossible to position the packers closely adjacent each other.

In the above identified co-pending application, an injection tool is disclosed wherein a plurality of vertically spaced packing elements are actuated by axial movements of a common mandrel traversing the bore of the packer body that mounts the packing element. For optimum efficiency, it is desirable to selectively open and close a recirculation or equalization fluid passage between the bore of the tubing string and the casing annulus above the upper most tool, and the provision of such apparatus in combination with the injection tool of the above-identified application is the object of the instant invention.

SUMMARY OF THE INVENTION

The invention relates to a tool for use in a well bore for producing hydrocarbons through a tubing string from a subterranean hydrocarbon bearing formation which has been perforated by a plurality of vertically spaced perforations. The tool includes a valving unit connected to a tubing string at its upper end and connected at its lower end to a packing unit. The packing unit includes a tubular body assembly, and, mounted on such assembly are upper and lower packing elements, each suitable for sealing the annular area between the tubing string and a casing or liner upon axial compression and radial expansion of the packing element. The packing elements can be set by longitudinal manipulation of a mandrel which is secured to the bottom end of a valving unit and is insertable into the tubular body assembly. An injection path is established through a port in the mandrel between the bore of the mandrel and the exterior of the packing unit. Such injection path includes an outer injection port in the tubular body assembly communicatin with the mandrel injection port and positioned between the upper and lower packing elements.

When a removable plug is positioned in the mandrel bore below the injection port, fluid supplied through the tubing string and valving unit can be injected through the mandrel port and through a small interval determined by the vertical spacing between the upper and lower packing elements.

A longitudinal bypass on the exterior of the mandrel provides a path for releasing annulus pressure acting on the expanded packing elements to facilitate the contraction or unsetting of the packing elements. Additionally, a radial port in the valving unit can be opened by rotation of the tubing string while the packing unit is set to establish communication between the tubing bore and the annulus, thus permitting recirculation and recovery of unused treatment fluid and also equalizing fluid pressures between the tubing string and the casing annulus to facilitate the release of the packing unit.

Further advantages of the invention will be readily apparent to those skilled in the art from the following detailed description, taken in conjunction with the annexed sheets of drawings, on which is shown a preferred embodiment of the invention.

BRIEF DESCRCIPTION OF THE DRAWINGS

FIGS. 1A through 1D comprise longitudinal continuations, vertical sectional views of the injection tool in its retracted position suitable for running into the well.

FIGS. 2A through 2D comprise longitudinal continuations, vertical sectional views of the injection tool positioned to inject fluids into the perforations in the casing communciating with a subterranean formation.

Figure 7A:
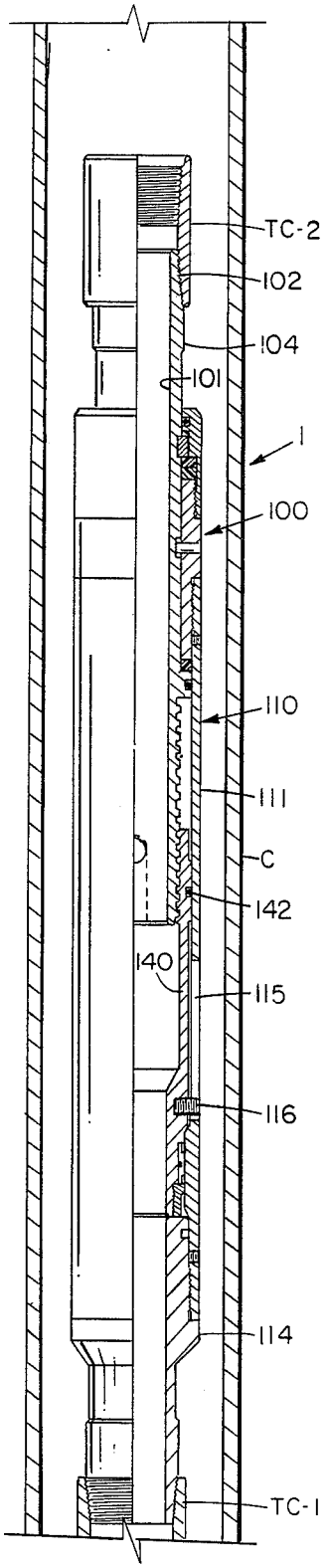
Figure 7B:
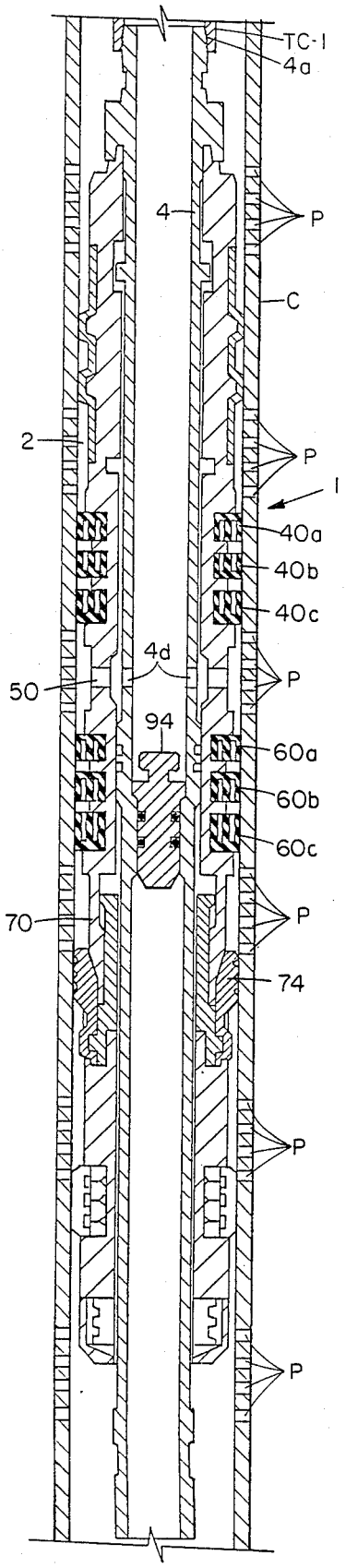

FIGS. 7A and 7B collectively represent a vertical sectional view of a tool embodying this invention shown in position in a well bore for injecting chemical treatment fluid into a selected group of well perforations.

Figure 8A:
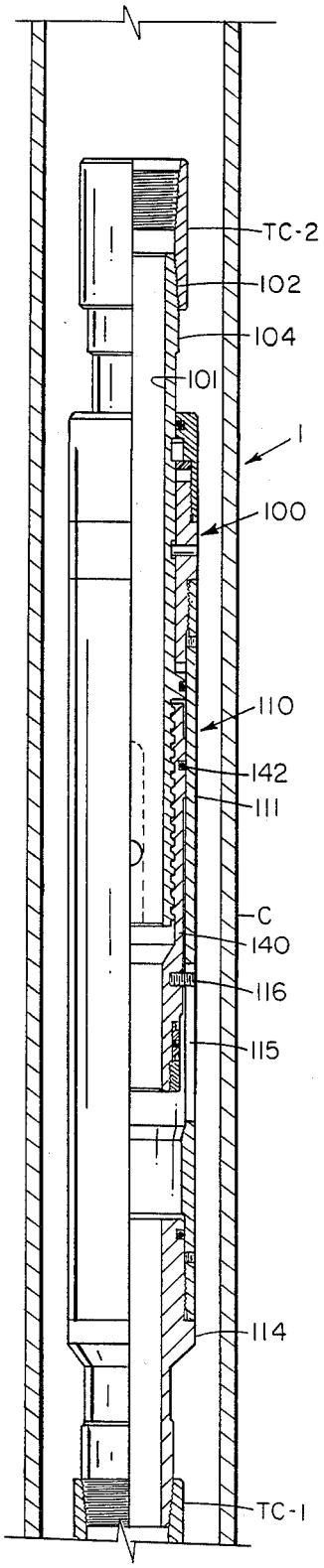
Figure 8B:
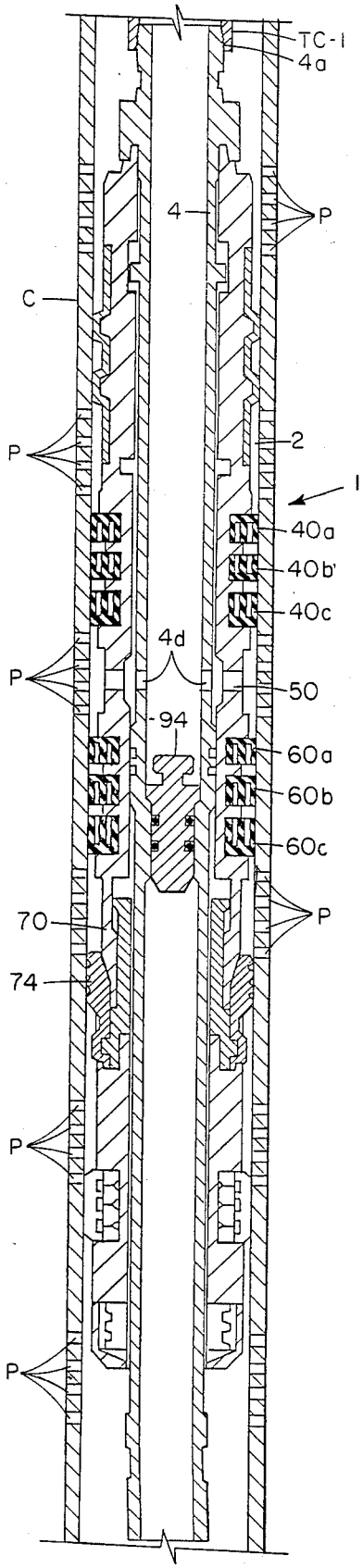

FIGS. 8A and 8B are views respectively similar to FIGS. 7A and 7B but showing the position of the tool elements when the valving tool is opened as a preliminary to unset the packing unit.

Figure 9A:
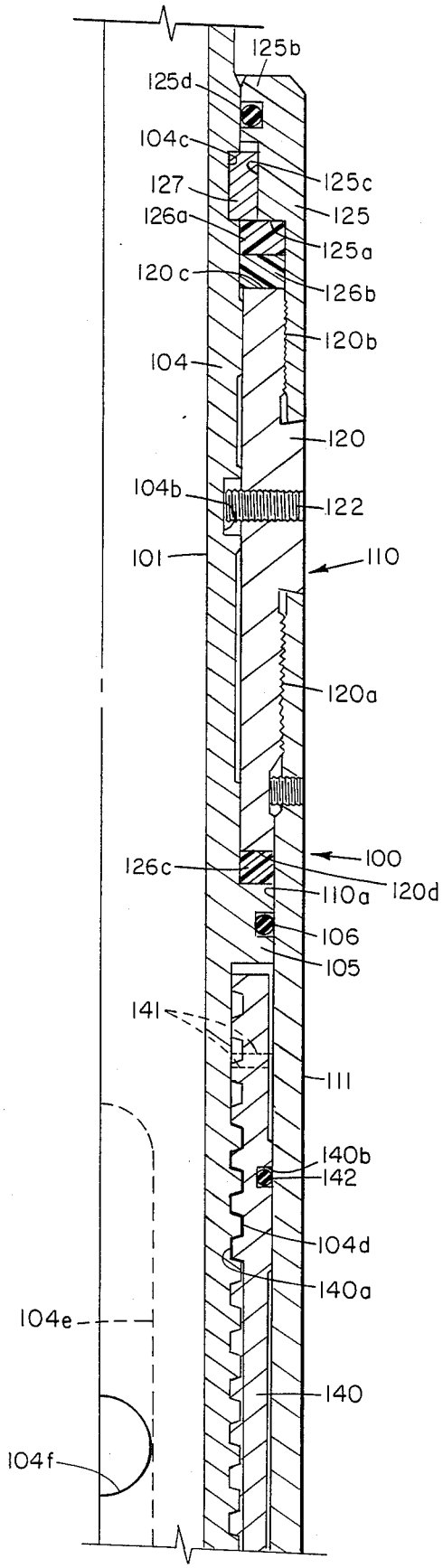
Figure 9B:
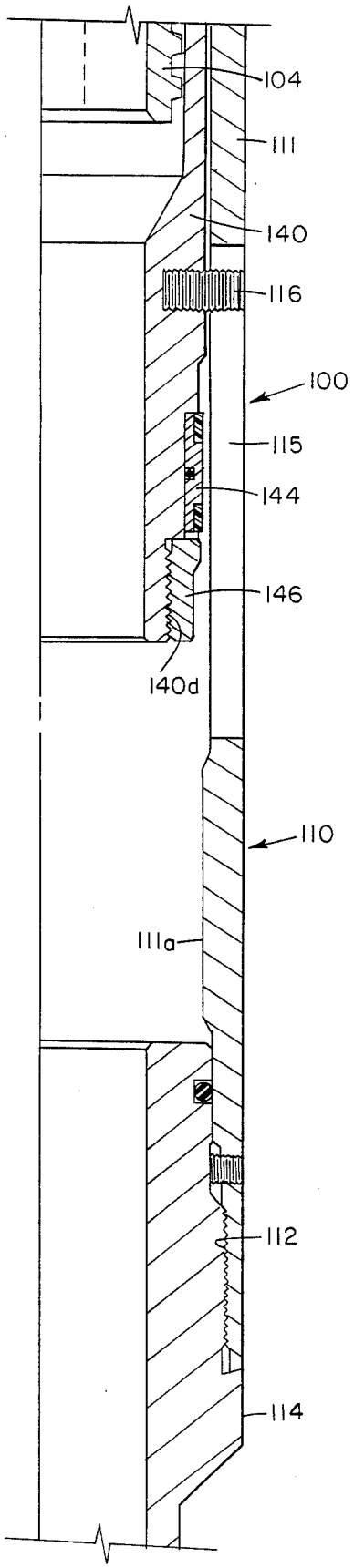

FIGS. 9A–9B collectively constitute an enlarged scale vertical quarter sectional view of the valving unit incorporated in the injection apparatus.

DESCRIPTION OF PREFERRED EMBODIMENT

FIG. 7 shows schematically all of the elements of a well tool 1 embodying this invention inserted in a well casing C having a plurality of vertically spaced perforations P communicating with a production zone. Tool 1 essentially comprises a packing or injection tool 2 connected in series relation with a valving unit 100 by an internally threaded coupling TC.

Packing tool 2 is identical to the tool described and claimed in the aforementioned co-pending parent application.

Packing tool 2 includes an upwardly projecting, hollow mandrel assembly 4 which has external threads 4*a* connecting with threaded coupling TC. Valving unit 100 is of annular configuration and has its upper end connected by a coupling sleeve TC-2 to a tubing string (not shown) which extends upwardly to the surface. A continuous fluid passage is thus defined between the bore of the tubing string, the bore 101 of valving unit 100 and the bore of mandrel assembly 4.

Referring now to Figs. 1A–1D, an upper unloader seal assembly including an annular elastomeric seal 14 is positioned adjacent the upper end of the mandrel 4. This upper unloader seal assembly comprises an upper seal retainer 6 secured to a lower seal retainer 8 by means of a threaded connection therebetween. A split ring retainer 10 held within an annular groove on the exterior of mandrel 4 engages the upper seal retainer member 6 and also engages a seal spacer 12. The retainer ring 10 and the seal spacer 12 are trapped between the upper seal retainer 6 and the lower seal retainer 8. Lower seal retainer 8 has a lower shoulder extending radially inwardly over a portion of the annular elastomeric upper seal ring 14 to hold the seal ring firmly secured around the exterior of mandrel 4.

Immediately below the upper seal assembly, including seal 14, the exterior of the mandrel 4 slopes inwardly to an outer diameter equivalent to that in section 4*b*. The outer diameter and thickness of the mandrel 4 remains essentially the same as shown at section 4*b* for that portion of the mandrel extending from the upper seal assembly to the lower end of the mandrel. A hydraulic hold-down housing 18 forming a portion of the exterior housing of the injection tool 2 extends around the upper portion of the mandrel section 4*b* and is attached by means of a threaded connection 18*b* to a cylindrical seal compressor 16. A rim 16*a* located at the upper end of seal compressor 16 has a reduced thickness and is opposed to the elastomeric seal 14. Seal compressor 16 is radially spaced from the exterior surface of mandrel section 4*b* by an amount sufficient to be radially coextensive with elastomeric seal 14.

Figure 1A:
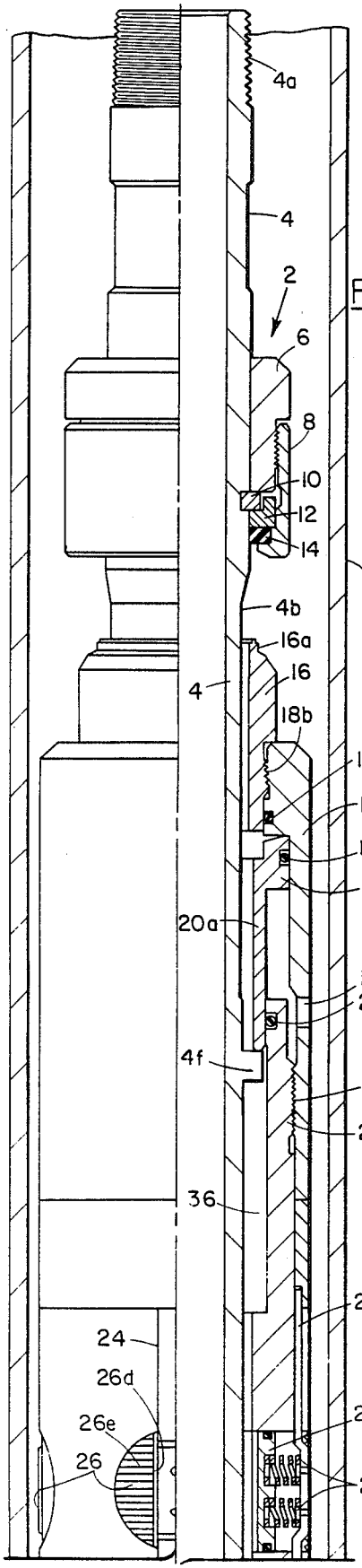

A port 18*a* extends through the exterior of housing section 18 and communicates with a cavity formed between the outer housing section 18 and a balance sleeve 20. Conventional seals 19 and 21 establish sealing integrity with balance sleeve 20. The diameter of O-ring seal 19 and the surface which it engages is greater than the diameter of O-ring seal 21 and the surface which it engages, thus creating a net pressure area on balance sleeve 20. Balance sleeve 20 is spaced from the mandrel 4 below the seal compressor 16. In FIG. 1A, balance sleeve 20 is located in its uppermost position. The bottom end of balance sleeve 20 engages a radially outwardly protruding lug 4f forming a part of the exterior of mandrel 4. Hydraulic hold-down receptacle 22 is positioned on the interior of the outer housing 18 and is secured thereto by threads 18*c* located adjacent the upper end of the hydraulic hold-down receptacle 22. O-ring 21 is positioned within an inner groove on hydraulic hold-down receptacle 22 and a reduced diameter lower section 20*a* of balance sleeve 20 contacts the inner surface of hydraulic seal receptacle 22. The receptacle 22 constitutes the upper portion of what may be called the tubular body assembly of the tool.

Figure 1B:
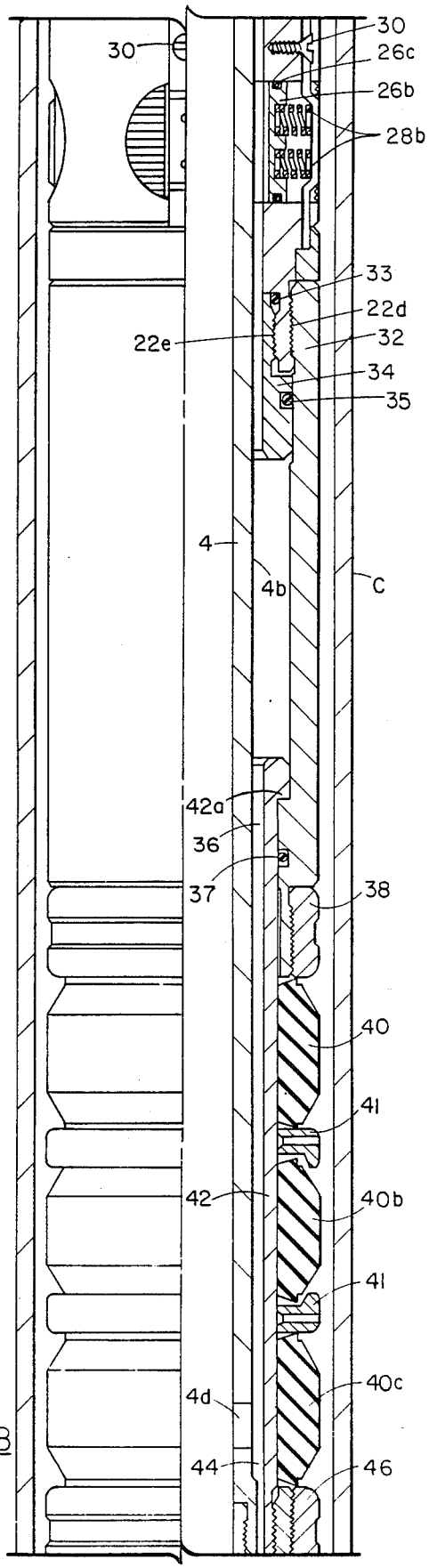
Figure 1C:
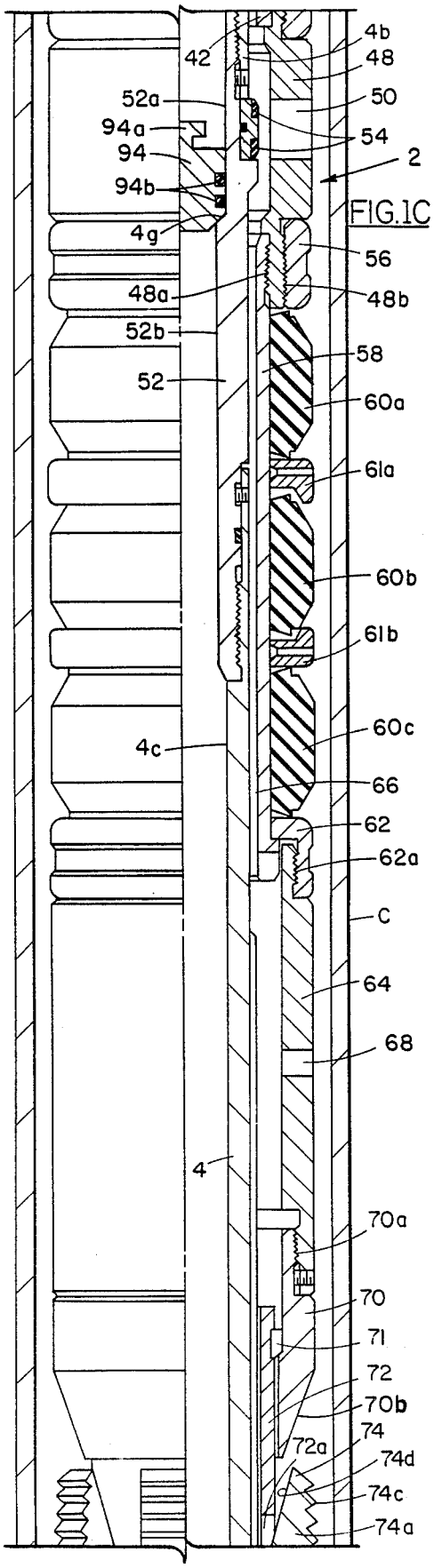
Figure 1D:
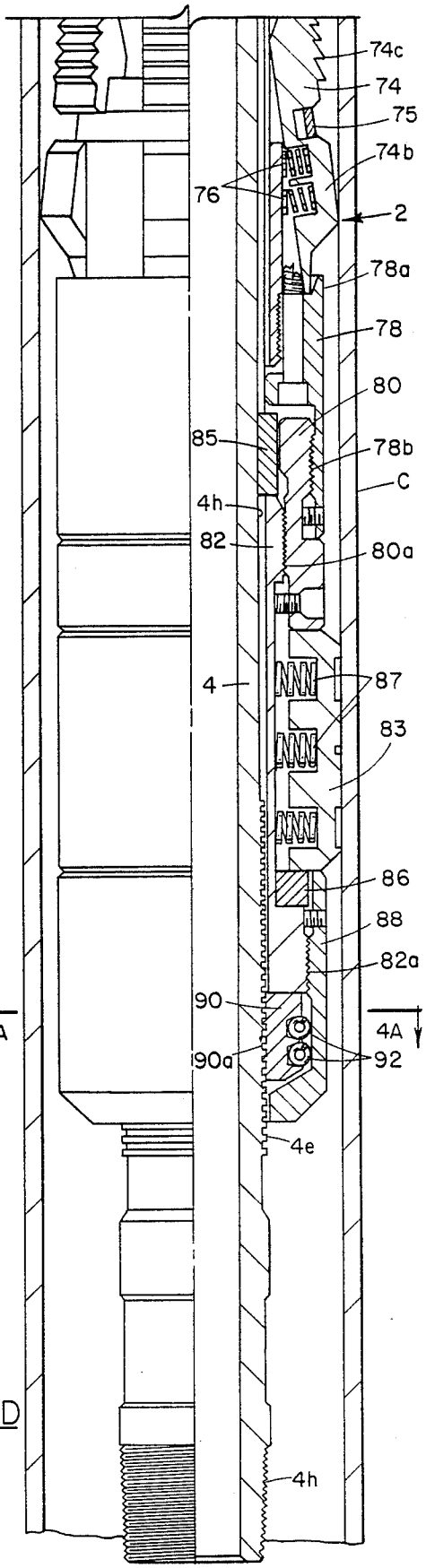

The hydraulic seal receptacle 22 has a plurality of radially extending cylindrical apertures 22*b*, each containing a hydraulic hold-down piston or button 26. In the preferred embodiment of this invention, a plurality of hold-down buttons are positioned circumferentially around the injection tool. As shown in FIGS. 1A and 1B, a pair 26*a* and 26*b* of hold-down buttons are positioned one above the other at each circumferential position The hold-down buttons are shown in FIGS. 1A and 1B in their retracted position. A retainer bracket 24 secured to the receptacle 22 extends longitudinally over the exterior of each hold-down button 26. The retainer bracket 24 is secured to the receptacle or body 22 by a plurality of flat-head screws 30. A pair of springs 28*a* and 28*b* engages each of the hold-down buttons 26*a* and 26*b* at each circumferential location. The hold-down buttons 26*a* and 26*b* each have an O-ring 26*c* extending therearound engaging radial cylinders defined in receptacle 22. Each hold-down button or piston is cylindrical and has a longitudinally extending groove 26*d* for receiving springs 28 and through which the bracket 24 extends.

An upper intermediate housing or body section 32 is attached to the hydraulic hold-down seal receptacle 22 by a threaded connection 22*d* and an O-ring seal retainer 34 is in turn secured to hydraulic hold-down receptacle 22 by internal threads 22*e* with O-rings 33 and 35 establishing sealing integrity. An upper portion 36 of a longitudinally extending bypass area is defined on the interior of the upper intermediate housing or body 32 and extends between the mandrel 4 and the seal receptacle 22 upwardly through the balance sleeve 20 and through the seal compressor 16 to communicate with the exterior of the injection tool in the configuration shown in FIGS. 1A and 1B.

A packing element mandrel 42 having an opposing shoulder 42*a* engaging the lower end of upper intermediate housing 32 extends concentrically relative to the inner mandrel portion 4*b* from the lower end of housing 32. An annular gage ring 38 engages the exterior lower end of housing 32 and forms an upper abutment for the uppermost packing element 40*a*. Three packing elements 40*a*, 40*b*, and 40*c*, each of conventional annular construction, surround the packing element mandrel 42. Two packing elements separators 41*a* and 41*b* are positioned on opposite ends of the intermediate packing element 40*b*. The packing elements can comprise a conventional elastomeric material. If desired, the packing elements can be fabricated of elastomeric elements of different durometers. A lower gauge ring 46 similar in construction to upper gauge ring 38 is positioned in abutting relationship to the lower end of packing element 40*c* which comprises the lowermost of the upper set of three packing elements.

As shown in FIG.. 1B, an inner injection port 4*d* extending through mandrel 4 establishes communication between the mandrel bore and the longitudinal bypass 36 formed around the exterior of mandrel 4. An outer ported section 48 (FIG. 1C) threadably secured at its upper end to gage ring 46 defines an exterior radial port 50 communicating between longitudinal bypass section 36 and the exterior of the tool immediately below the upper set of packing elements 40*a*, 40*b*, and 40*c*. The outer ported section 48 has an inner diameter which is greater than the inner diameter of the upper packing element mandrel 42 and which is also greater than the inner diameter of a lower packing element mandrel 58 secured to the lower end of the ported section 48 by threads 48*a*. Therefore the thickness of the longitudinal bypass longitudinally above and below the ported section 48 is less than the thickness of the bypass on the interior of ported section 48.

In the preferred embodiment of this invention, the inner mandrel 4 can comprise a plurality of threaded sections. A lower unloader seal support comprising a tubular metallic section 52 (FIG. 1C) having annular elastomeric sections 54 secured to the exterior thereof, is threadably secured between the sections 4*b* and 4*c* of mandrel 4. In the configuration shown in FIG. 1C, the lower unloader seals 54 can be positioned in the portion of the longitudinal bypass adjacent port 50. In this section of the longitudinal bypass, seals 54 do not engage an interior surface and the longitudinal bypass is continuous between the upper section 36 and a lower section 66.

Additionally, the unloader seal support 52 comprises a seal bore portion 52*a* immediately above a constricted bore portion 52*b*. The upwardly facing shoulder 4*g* thus defined provides a mounting for a wireline removable plug 94 having seal elements 94*b* and a fishing neck 94*a*. If desired, a conventional locking type, wireline removable plug may be substituted for plug 94 which will facilitate selective swabbing of the perforations.

A gauge ring 56 is secured to the lower end of ported section 48 by the threads 48*b* and abuts the upper end of the uppermost of three lower packing elements, 60*a*, 60*b*, and 60*c*. Each of these packing elements is conventional in nature and can be similar in construction to the corresponding packing elements 40*a*, 40*b*, and 40*c* located above the ported section 48. Similar packing elements separators 61*a* and 61*b* are located above and below the central packing element 60*b* of the lowermost set of three packing elements. These packing elements 60*a*, 60*b*, and 60*c* surround and engage the lower packing element mandrel 58 in the same manner that the upper packing elements 40*a*, 40*b*, and 40*c* engage the upper packing element mandrel 42. The lower section 66 of the longitudinal bypass extends between packing element mandrel 58 and the adjacent portion of the mandrel 4.

A lower gauge ring 62 is secured by threads 62*a* to a tie sleeve 64 which comprises a cylindrical member defining the portion of the outer tool housing below packing element 60. A radial port 68 extending through tie sleeve 64 establishes communication between the lower section 66 of the longitudinal bypass and the exterior of the tool.

An expander cone 70 is secured to the lower end of tie sleeve 64 by means of conventional threaded connection 70*a*. A rocker slip sleeve 72 is secured to the upper cone 70 by means of an annular snap ring 71. The rocker slip sleeve 72 has a plurality of grooves 72*a* located circumferentially therearound for receiving the inner portions of conventional rocker slips 74. Each of the several rocker slips 74 located circumferentially around the lower end of the injection tool is spring loaded relative to the lower end of the rocker slip sleeve 72 by a plurality of springs 76, which engage the inner surface of lower drag section 74*b* of the rocker slip. The rocker slip assembly, comprising a plurality of equally spaced rocker slips is held in position by a rocker slip retainer ring 75 located just above the rocker slip drag sections 74*b*. In the configuration shown in FIG. 1D, the springs 76 bias the lower section of the rocker slip outwardly so that drag section 74*b* is the outermost section of the injection tool.

Figure 5:
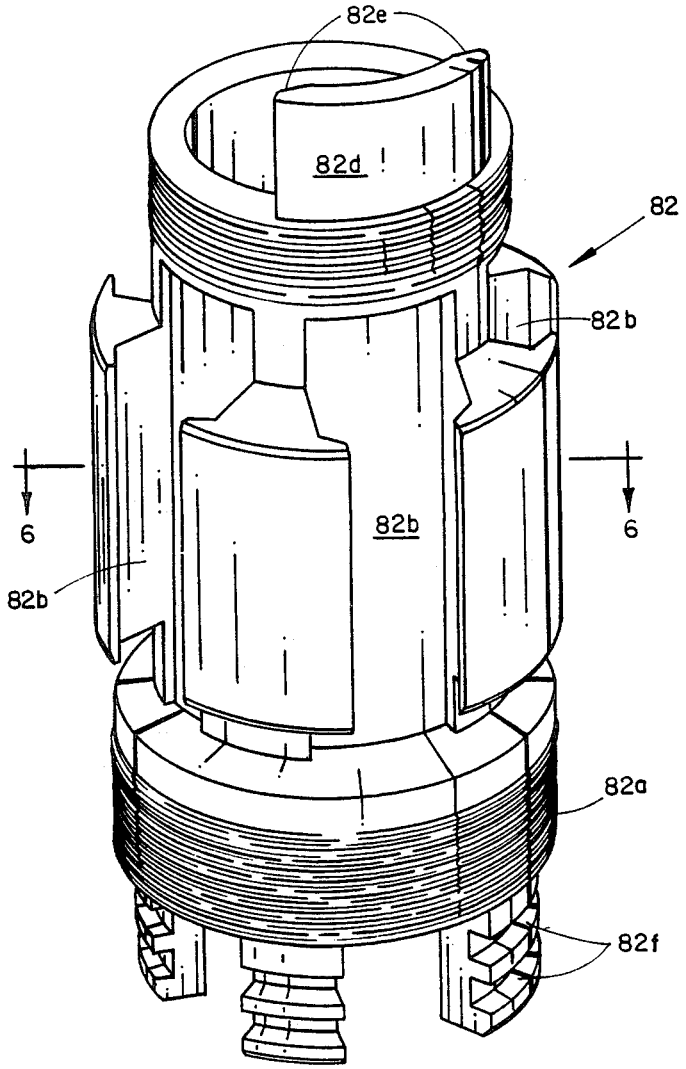
FIG. 5 is a perspective view of the drag block housing.
Figure 6:
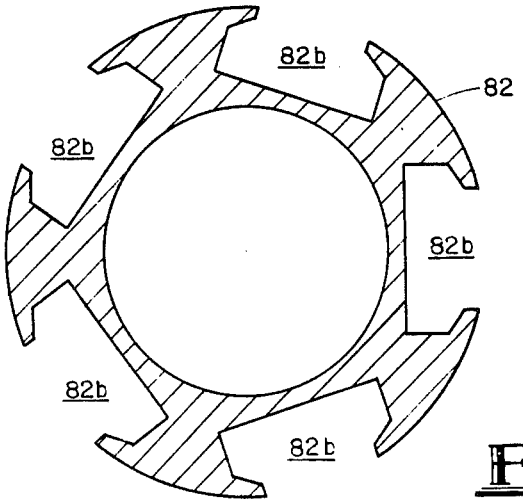
FIG. 6 is a sectional view taken on the plane 6—6 of FIG. 5.

The upper end 74*a* of each rocker slip 74 comprises a section having a serrated outer surface 74*c* and an inclined inner surface 74*d* opposed to a cooperable camming surface 70*b* on the lower end of cone 70. In the retracted configuration shown in FIGS. 1C and 1D, the rocker slips 74 are spaced from the cone 70. The lower end of the rocker slip 74 is captured by an outer lip 78*a* on sleeve 78 to hold the rocker slip 74 in the run-in position Sleeve 78 is secured to a cross-over sleeve 80 by conventional threads 78*b*. The cross-over sleeve 80 is in turn secured to a drag block segment retainer housing 82 (FIG. 5) by threaded connections 80*a*. A plurality of peripherally spaced, longitudinal dove-tailed recesses 82*b* are provided in housing 82 to respectivelY accomodate drag blocks 83 which are urged outwardly by springs 87.

Figure 4B:
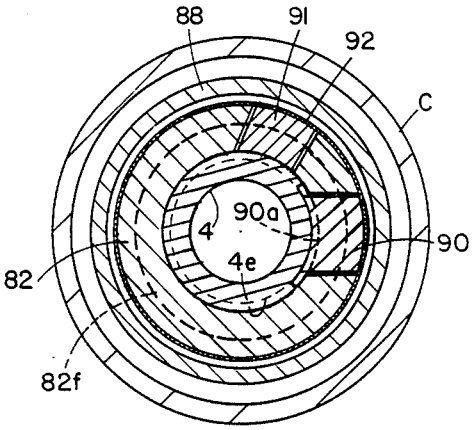
FIG. 4B is a sectional view taken on the plane 4B—4B of FIG. 2D.
Figure 4A:
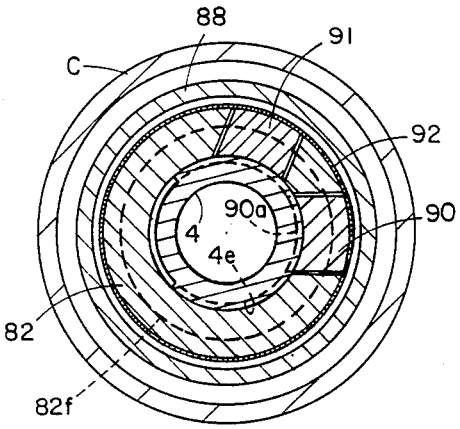
FIG. 4A is a sectional view taken on the plane 4A—4A of FIG. 1D.

At the lower end of the housing 82, an outer lock segment retainer 88 is secured by threaded connection 82*a* to lock segment housing 82. A lock segment 90 having teeth 90*a* on its inner surface and a dummy lock segment 91 having no teeth are retained within the lock segment housin 82 by the outer retainer 88. Coil springs 92 (FIGS. 4A and 4B) extend circumferentially around the grooves 82*f* in housing 82 and the lock segments 90 and 91 to hold the segments in a radially retracted position. The horizontal teeth 90*a* on the inner surface of lock segment 90 engage cooperating horizontal grooves 4*e* extending partially around the lower portion of the mandrel 4 (FIG. 4A) to prevent axial movement of mandrel 4 relative to the rest of the tool.

The mandrel 4 may thus be released from the lock segment by limited angular rotation. The limit to the rotation is provided by an axial tab 82*d* (FIG. 5) on the top end of drag block housing 82 which engages a key 85 which is secured in a longitudinal slot 4*h* in the periphery of the mandrel 4 by the cross over sleeve 80. If the opposite direction of rotation of mandrel 4 is desired to release the mandrel to set the packer, then it is only necessary to reverse the positions of threaded lock segment 90 with unthreaded lock segment 91. A bevel 82*e* on each axial edge of tab 82 forces key 85 into slot 4*h* and improves the reliability of the key.

At the lower end of the mandrel 4, threads 4*h* provide a means for securing the mandrel 4 to a portion of the tubing string extending below the packing or injection tool 2.

FIG. 2 shows the actuation of the packing or injection tool 2 to permit injection of fluids through a single selected set of perforations, without injecting into closely adjacent perforations axially spaced from the selected perforations by distances of as little as 6 inches. As shown in FIG. 3, the upper set of packing elements 40 can be positioned above the selected set of perforations P while the lower set of packing elements 60 can be positioned below this same selected set of perforations. Expansion of packing elements 40 and 60 will then seal the annulus above and below the selected set of perforations and isolate the annular area surrounding the selected set of perforations from closely adjacent perforations above and below.

Figure 2A:
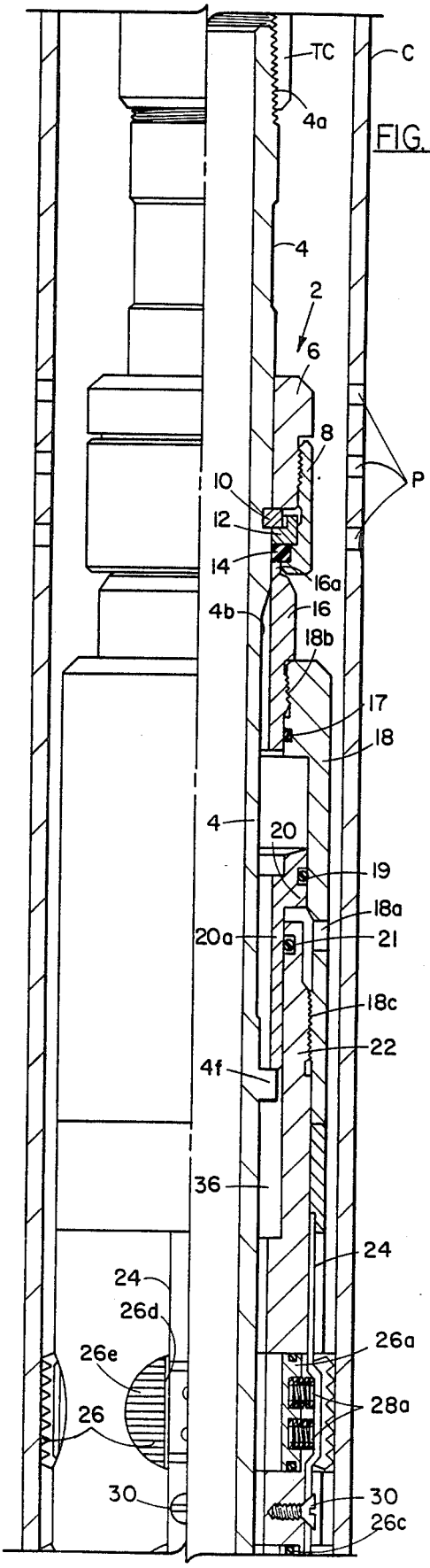
Figure 2B:
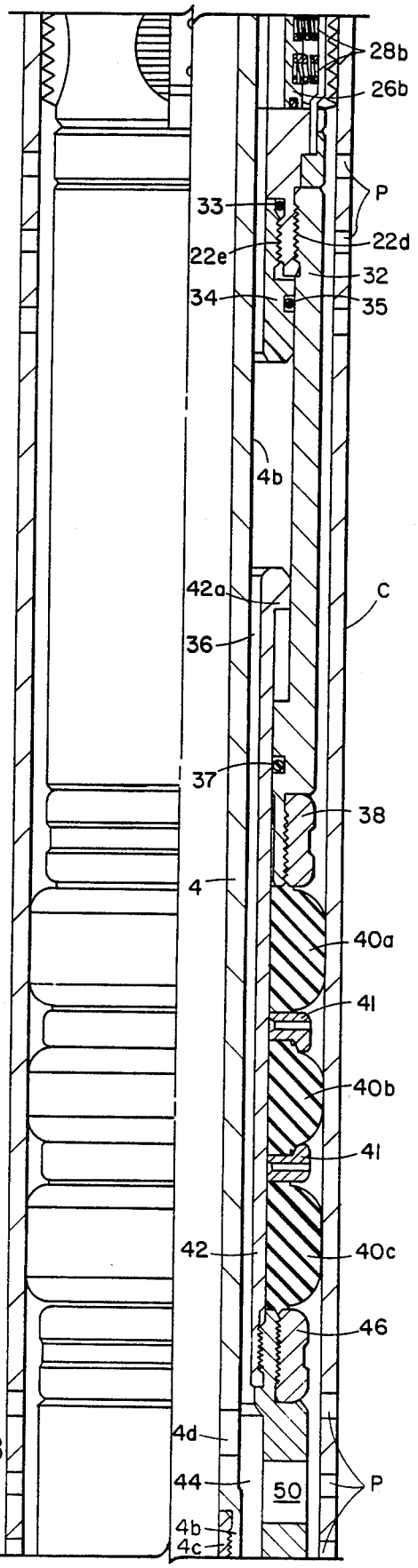

To position the packing tool 2 as shown in FIGS. 2A, 2B, 2C, and 2D the tool is lowered into a position adjacent the selected perforations P, with the tool in the configuration shown in FIGS. 1A, 1B, 1C and 1D. The lock segment 90 engagement with grooves **4*e* (FIG. 4A) prevents expansion of slips 74 and of the packing elements 40 and 60. When the outer injection port 50 has been positioned adjacent a designated set of perforations P as shown in FIG. 2B, partial rotation of the tubing T in a previous selected direction releases mandrel 4 for axial movement relative to the lock segment 90. As the tubing T is rotated, the grooves 4*e* are disengaged from lock segment 90 (FIG. 4B) to permit downward movement of the mandrel 4. During the partial rotation of the mandrel 4, the drag block section 74*b* of the rocker slips 74 and drag blocks 83** engage the casing C to prevent rotation of the lock segment and the lock segment housing relative to the casing.

Downward movement of mandrel 4 relative to the rocker slips 74 brings the inclined surface **70*b* of expander cone 70 into engagement with the lower surface of the slip portion 74*a* of the rocker slips. Slip portion 74*a* is thus firmly wedged into engagement with the casing and the teeth bite into the casing and prevent further downward movement of rocker slip 74 relative to the casing. Continued downward movement of the mandrel 4, after the slips 74 are firmly wedged into engagement with the casing, is transmitted through the upper unloading assembly which is shifted downwardly into engagement with seal compressor 16. This downward movement of the mandrel 4 is transmitted through the retainer housing 18 and the hydraulic hold-down receptacle 22 to outer housing 32. Downward force applied to inner mandrel 4 is thus transmitted to packing elements 40 and 60, which are compressed by continued downward movement of the mandrel 4 relative to the now stationary lower housing section 64. Thus, the compressive force applied to the packing elements 40 and 60** causes radial expansion of the packing elements into engagement with the casing to seal the annulus between the tubing T and the casing C.

Figure 2C:
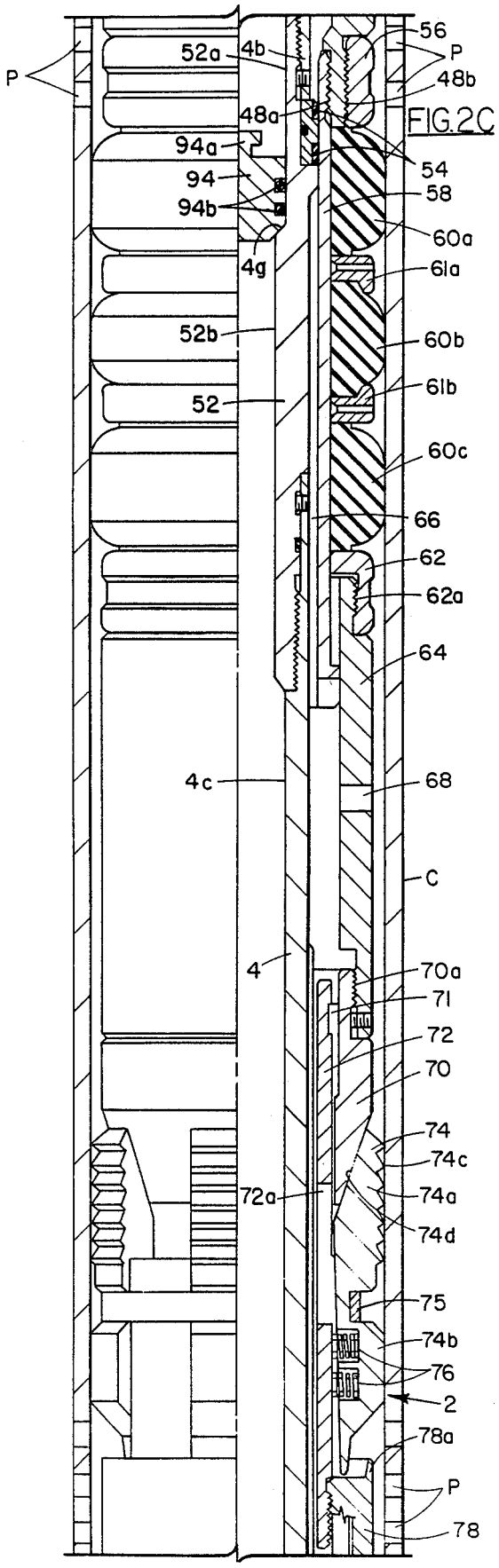
Figure 2D:
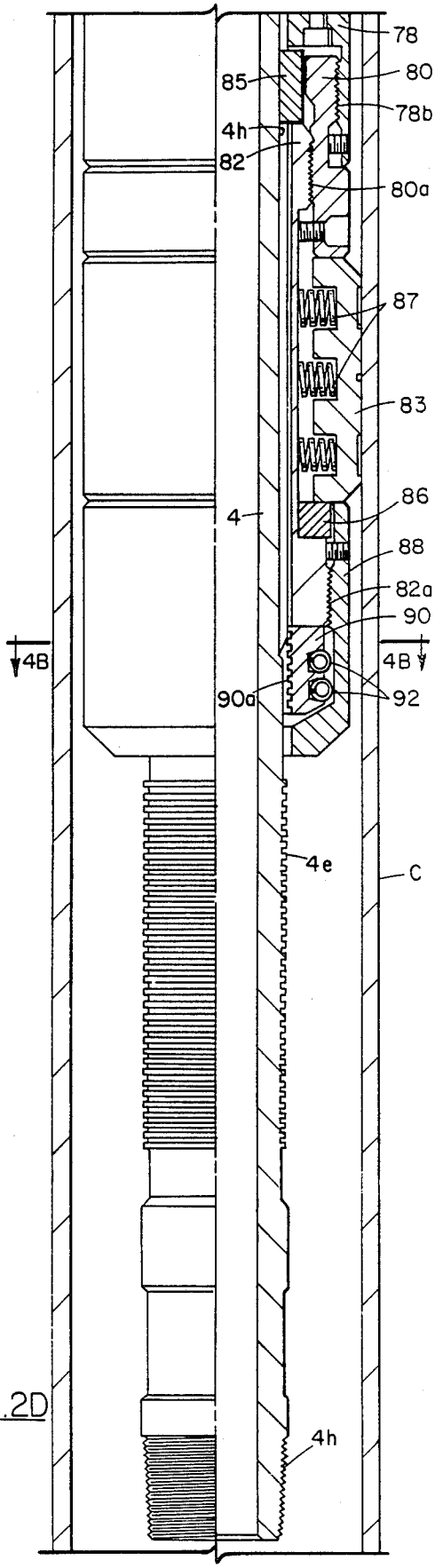
Figure 3:
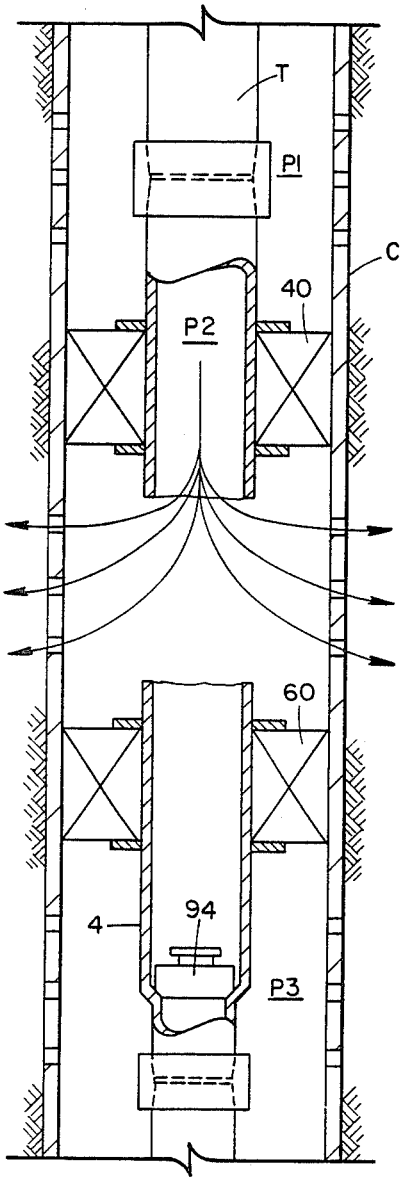
FIG. 3 is a schematic view illustrating the injection of fluids through the injection tool of FIGS. 2A through 2D into one of several closely adjacent formations.

The packing tool 2 is now in position to inject fluids through the selected perforations P adjacent the outer injection port 50. If not positioned in the tool as it is run into the well, the removable plug 94 can be positioned in engagement with mandrel seat **4*g* by conventional means. The removable plug 94 shown here can be lowered into the well by wireline means. With the plug in place and in engagement with seat 4*g*, fluid injected through the tubing would pass through mandrel port 4*d* into the longitudinal bypass upper section 36 adjacent the outer injection port 50. During setting of the injection tool, the lower seals 54 will have been shifted into a position in engagement with the more restricted portion of the longitudinal bypass 66, as shown in FIG. 2C. Thus, fluid cannot pass through the longitudinal bypass past seals 54. Fluid injected through mandrel port 4*d* cannot communicate with the annulus above packing elements 40 through longitudinal bypass portion 36 because the upper unloader seal 14 is held in engagement with the seal compressor 16 by the downward force applied to the mandrel 4. The injection pressure is, however, communicated through longitudinal bypass portion 36 to the balance sleeve 20. A differential pressure force equal to the difference between the injection pressure within longitudinal bypass 36 and the pressure in the annulus acting on balance sleeve 20 through port 18*a* acts across an area between seals 19 and 21. This pressure force shifts the balance sleeve 20 downwardly, maintaining it in engagement with the mandrel lug 4*c*. Thus any force due to injection pressure exceeding annulus pressure will act through balance sleeve 20 downwardly on mandrel 4** to insure that the mandrel stays in its downwardly shifted position.

Pressure of fluid injected through mandrel 4 will not act upwardly on the outer portion of the injection tool to release the tool since this pressure will act through longitudinal bypass portion 36 on the hydraulic hold-down buttons **26*a* and 26*b*. This pressure will shift the buttons outwardly, compressing springs 28*a* and 28*b*. In the preferred embodiment of this invention, the hydraulic hold-down members have serrated teeth 26*e*** and these teeth engage the casing to secure the injection tool against upward movement.

In the event the annulus pressure below lower packing element 66 were to exceed the annulus pressure above the tool, this pressure would be transmitted through the open bottom end of the lower portion **4*c* of the mandrel 4 through port 4*d* into the upper section of the longitudinal bypass 36. Of course, the removable plug 94 would be unseated by this excess pressure existing below the tool. Thus, in the event of a greater pressure below than above the tool, this pressure would be transmitted through longitudinal bypass section 36 to act on the hydraulic hold-down buttons 26*a* and 26*b*** in the manner just described. Thus, the tool will not be unseated or forced to move up the well bore.

The injection tool is fully retrievable and is resetable within the well. Thus, the tool 2 could be repeatedly shifted from the location of perforations through which fluid has just been injected and can be repositioned with the outer injection port in proximity to other perforations. Normal injection procedure would involve positioning the injection tool adjacent the lower set of perforations and then sequentially repositioning the injection tool to inject at each subsequent set of perforations above the first set of perforations. At each subsequent set of perforations, the mandrel merely needs to be lowered to set the slip 74 and packing elements 40 and 60 as previously described. When the tool 2 is shifted upwardly, the mandrel is moved in an upward direction. Thus, the compressive force supplied by the mandrel 4 to the packing elements 40 and 60 would be released and the cone 70 can be moved form beneath the slip portion **74*a* of the rocker slip 74**.

The packing elements 40 and 60 would not tend to remain in their expanded configurations due to any pressure differential acting in the annulus across either set of packing elements. Upward movement of mandrel 4 will equalize the pressure across upper packing elements 40 by establishing communication between the annulus above the injection tool through longitudinal bypass section 36 and through the injection port 50 to the annulus below packing elements 40. Movement of the unloader seal 14 out of engagement with seal compressor 16, serves to establish such pressure equalization and pressure communication. After pressure is equalized across upper packing elements 40, as a result of movement of unloader seal 14 away from seal compressor 16, any pressure differential existing across packing element 60 can be relieved as the lower unloader seal 54 moves from within the restriction in lower bypass section 66 to the larger diameter portion proximate to outer injection port 50. A pressure equalization path is then established from the annulus below the packing element 60 through port 68, through the lower longitudinal bypass portion 66, through the injection port 50 to the annulus above lower packing element 60. This tool therefore provides an easily repeatable releasing procedure in which the mandrel 4 is merely manipulated in a longitudinal fashion to both release the packing elements 40 and 60 and the slips 74 and to equalize pressure across both sets of packing elements 40 and 60.

Lastly, the mandrel 4 may be partially rotated to re-engage grooves **4*e* with lock segment 90, thus permitting lowering of all the components of the tool 2** to a new lower position.

During the aforedescribed operation of the packing tool 2, the valving tool 100 remains in the position illustrated in FIG. 7A, wherein the bore 101 of the valving tool 100 provides communication between the bore of the tubing string and the bore of the hollow mandrel assembly 4 of the injection too 2. It has been found that when an attempt is made to unset the injection tool 2 to move to a new location relative to the vertically spaced perforations, difficulty is encountered in the unsetting operation if any fluid pressure differential exists between the casing annulus and the bore of the hollow mandrel assembly 4. The valving tool 100 permits the opening of a large passage between the bore 101 of such tool and the casing annulus in response to rotation of the tubing string through a number of turns. Thus, the fluid pressure between the casing annulus and the bore of the hollow mandrel assembly 4 is completely equalized.

The valving tool 100 comprises a tubular inner valve body 104 having the threads 102 at its upper end for connection to the threaded coupling TC 2 and thus to the end of the tubing string (not shown). The tubular inner body 104 is surrounded by and sealably engaged with the bore of an outer tubular body assemblage 110. The outer tubular body assemblage 110 is provided at its lower end with internal threads 112 for connection to a connecting sub 114 which in turn is externally threaded at its bottom end for connection with the threaded coupling TC 1 which connects with the injection tool 2. An O-ring 106 is provided in a radially enlarged shoulder portion 105 of the tubular inner body 104 and provides a sealing engagement with the inner bore wall **110*a* of the outer tubular body assemblage 110**.

A bearing support sleeve 120 is provided having external threads **120*a* on its lower end which is threadably engaged with internal threads provided on the upper end of the primary body member 111 of the outer tubular body assemblage 110. Bearing support sleeve 120 mounts a shear screw 122 which engages a suitable depression 104*b* provided in the inner tubular body 104. Shear pin 122 thus prevents relative rotation of the inner tubular body 104 with respect to the outer tubular body assemblage 110 until sufficient force is applied to effect the shearing of shear screw 122**.

Additionally, the bearing support sleeve 120 forming the upper part of outer tubular body assemblage 110 is provided with external threads **120*b* to which is secured a bearing retainer sleeve 125. Bearing retainer sleeve 125 has an inwardly projecting radial shoulder 125*a* which engages the top of a thrust bearing 126*a*, which is preferably fabricated from a self lubricating material such as that sold under the trademark "Teflon". A steel thrust bearing 126*b* underlies the Teflon bearing 126*a* and abuts the top end 120*c* of bearing support sleeve 120. A Teflon, bearing 126*c* is disposed between the radial shoulder 105 on inner body 104 and the bottom end 120*d* of bearing support sleeve 120**.

Bearing support sleeve 120 further defines an internal cylindrical surface **125*c* which cooperates with an annular groove 104*c* formed in the inner body assembly 104 to provide a mounting for a C-ring 127 which locks the outer tublar assemblage 110 to the inner tubular body assemblage 104 but permits unrestricted rotation between such elements. Additionally, the upper end 125*b* of bearing retainer sleeve 125 projects inwardly to a position closely adjacent to the surface of the inner tubular body 104 and mounts an O-ring 125*d* for effecting a seal between the inner tubular body 104 and the outer tubular body assemblage 110**.

The lower primary portion 111 of tubular body assemblage 110 is provided with a plurality of peripherally spaced, axially extending fluid flow slots 115. A valving sleeve 140 is mounted within the bore of the lower primary portion 111 of the tubular outer body assemblage 110 for axial movements with respect to the outer tubular body assemblage 110, hence with respect to the flow slots 115. Valving sleeve 140 is provided with internal threads **140*a* which cooperate with similarly shaped external threads 104*d* provided on the lower end of the inner tubular body 104. A pair of bolts 116 mounted in valving sleeve 104 respectively engage the flow slots 115 to prevent rotational movement of valving sleeve 104 when the packing tool 2 is set. Accordingly, the rotational movement of the tubing string will effect an axial displacement of the valving sleeve 140 relative to the peripherally spaced slots 115. A conventional helical stop 141 is machined into threads 104*d* and 140*a* to limit the upward movement of valving sleeve 140** without binding.

In the closed position of the valving sleeve 140, (FIG. 7A), which corresponds to the sleeve being displaced downwardly by rotation of the tubing string, the peripherally spaced flow slots 115 are sealed at their upper end by an O-ring 142 mounted in an annular groove **140*b* provided on the exterior of the valving sleeve 140. The lower ends of the flow slots 115 are sealed by engagement of a molded seal 144 secured to the bottom end of the valving sleeve 140 by an internally threaded retaining sleeve 146 which is screwed onto external threads 140*d* provided on the bottom end of the valving sleeve 140. Molded sleeve 144 cooperates with an internally projecting cylindrical sealing surface 111*a* provided in the lower primary body portion 111 at a location below the peripherally spaced slots 115. Thus the slots 115 are bracketed by the O-ring seal 142 and the molded seal 144 so that fluid passage through the peripherally spaced slots 115** is prevented.

When it is desired to equalize fluid pressure between the casing annulus and the bore of the tubing string, the tubing string is rotated to the right, shears pin 122 and effects an upward displacement of the valving sleeve 140, removing the molded seal 144 from engagement with the sealing surface **111*a* and opening a radial path for fluid flow through the peripherally spaced flow slots 115**.

The provision of the valving tool 100 is not only desirable for equalizing annulus and tubing pressure prior to effecting the unsetting of the injection tool 2 but also may be utilized at the conclusion of a chemical treatment operation to reverse flow the chemical treatment fluids contained in the bore of the tubing string by opening the valving tool 100 and applying fluid pressure to the annulus fluid to effect an upward flow of the remaining chemical treatment fluid through the tubing bore to the surface for recovery.

Those skilled in the art will recognize that the described construction of the valving tool 100 depends for successful operation on the prevention of trash accumulation between the threads 104*d* on the inner tubular body 104 and the cooperating internal threads 140*a* on the valving sleeve 140. The accumulation of any such trash may be prevented through the provision of a plurality of peripherally spaced, axially extending grooves 104*e* which traverse the threads 104*d*. A radial port 104*f* connects each of the grooves 104*e* to the bore 101 of the valving tool 100 and permits any trash to drain downwardly through such bore.

In addition to equalizing annulus pressure with tubing bore pressure, the tool embodying this invention has further utility in that it permits a change of well fluid, or removal of treatment fluid without imposing circulation pressure on the formation. By opening the valving tool 100, any acid or other treating fluid contained in the bore of the tubing string may be pumped out of the tubing string by applying a pressure to an appropriate annulus fluid. For example, at the conclusion of an acid treatment job, the packing tool 2 of this invention would be unset and moved up above the production formation with the mandrel plug still in the setting tool 2. The packing tool would be reset at the new location, the valving tool 100 would be opened by rotation of the tubing string and the acid contained in the bore of the tubing string would be reversed out of the tubing string through the application of pressure to the annulus fluid. In this manner, the fluid in the tubing bore can be replaced with a lighter completion fluid without putting any circulation pressure on the formation.

In the event that the injection and packing tool 2 should plug during the chemical treatment process, the valving tool 100 can be opened and through the application of pressure down the casing annulus, the acid or other treatment fluid can be removed from the tubing. Appropriate remedial action to remove the plugging could then be taken either by inserting tools through the tubing bore or pulling the tubing string which is now free of acid.

Those skilled in the art will recognize that any standard injection valve may be interposed between valving tool 100 and the tubing string. For example, the valve shown in co-pending application Ser. No: 790,876, filed Oct. 24, 1985, (BST-75), and assigned to the Assignee of this application may be utilized to control the quantity and the rate of chemical treatment fluid supplied to any selected vertical group of perforations.

Although the invention has been described in terms of specified embodiments which are set forth in detail, it should be understood that this is by illustration only and that the invention is not necessarily limited thereto, since alternative embodiments and operating techniques will become apparent to those skilled in the art in view of the disclosure. Accordingly, modifications are contemplated which can be made without departing from the spirit of the described invention.

What is claimed and desired to be secured by Letters Patent is:

1. For use in a subterranean well having a casing traversing a production zone, the casing and production zone having a plurality of vertically spaced perforations, apparatus for chemically treating selected portions of the production zone comprising: a tubing supported valve having a tubular body; a radial port in said tubular body providing communication between the tubing bore and the casing annulus; port closing measn slidably and sealably mounted in said valve body for movement between a normal closed position overlapping said radial port and an open position axially spaced from said port; a valve actuating sleeve sealably and rotatably mounted in the upper end of said valve body; means on one end of said valve actuating sleeve for securement to a tubing string; packer means comprising a tubular packer body assembly; a hollow mandrel telescopically inserted in said tubular packer body assembly; a plurality of radially expandable and retractable packing elements mounted in axially spaced relationship on said tubular packer body assembly, each of said elements comprising means for sealing the annular area between the tubing string and the weel bore upon radial expansion thereof; means for expanding and retracting said packer body assembly by axial movement of the tubing string; a radial injection path communicable between the mandrel bore and the exterior of said packer body assembly, said radial injection path being located between two said packing elements; and seal means for sealing the mandrel bore below the injection path, whereby said packer means may be set by axial manipulation of the tubing string with said packing elements straddling a selected vertical group of perforations; threads interconnecting said actuating sleeve and said port closing means, whereby rotational movement of the tubing string shifts said port closing means axially between said open and closed positions when said packing elements are set, whereby treatment fluid may be supplied through the tubing string to the selected vertical group of perforations when said port closing means is in its normal closed position; said packer body assembly and said tubing supported valve being shiftable to a location above the selected perforations without effecting a change in said port closing means from its said normal port closing position; said tubing string being rotatable in said elevated position to effect the shifting of said port closing means to its open position, thereby equalizing pressure between the well annulus and the tubing bore and permitting recovery of unused chemical treatment fluid disposed in the tubing bore.

2. The apparatus of claim 1 wherein said threads are respectively provided in the upper end of said port closing means and on the lower end of said valve actuating sleeve, said valve actuating sleeve having a shallow, axially extending groove traversing its threads; and a radial hole through said valve actuating sleeve connecting with said shallow groove to provide a trash drain for said threads.

3. The apparatus of claim 1 further comprising releasable means for securing said mandrel to said tubular packer body assembly for run-in, said mandrel being releasable from said packer body assembly by limited angular movement of said mandrel relative to said packer body assembly.

4. The apparatus of claim 1 wherein said port closing means comprises a sleeve threadably connected to said valve actuating sleeve whereby rotation of the tubing string axially shifts said port closing sleeve between said open and closed positions.

5. The apparatus of claim 4 further comprising means for draining particulate deposits from said threadable connection.

* * * * *